US005452485A

United States Patent [19]

Ross

[11] Patent Number: 5,452,485

[45] Date of Patent: Sep. 26, 1995

[54] GLIDING TUB AND SHOWER CLEANER

[76] Inventor: Leslie Ross, 35 Houghton St., Somerville, Mass. 02143

[21] Appl. No.: 284,146

[22] Filed: Aug. 2, 1994

[51] Int. Cl.[6] ..... E03C 1/00

[52] U.S. Cl. ..... 4/662; 15/246

[58] Field of Search ..... 4/606, 661, 662; 15/246, 246.5; 134/123

[56] References Cited

U.S. PATENT DOCUMENTS

| | | | |
|---|---|---|---|
| 3,381,312 | 5/1968 | Whitla | 4/662 |
| 3,604,434 | 9/1971 | Hurst | 134/123 X |
| 3,837,011 | 9/1974 | McTighe et al. | 4/662 |
| 5,335,378 | 8/1994 | Chiang | 4/606 |

FOREIGN PATENT DOCUMENTS

| | | | |
|---|---|---|---|
| 0059134 | 9/1982 | European Pat. Off. | 4/662 |

*Primary Examiner*—Robert M. Fetsuga
*Attorney, Agent, or Firm*—John P. McGonagle

[57] ABSTRACT

A gliding tub and shower cleaning device for automatically cleaning a bath tub and a shower stall. The device consists of a control center, a tub glider and a shower glider. The tub and shower gliders have brushes attached and are connected to drive systems which move the gliders around the inside of the shower stall and the bathtub on tracks. The tracks contain a continuous fluid path for transporting fluid from the control center to the gliders. The tub and shower gliders spray a cleaning solution mixture and the brushes contact and remove dirt and grime from the walls and bottom of the shower and bathtub.

16 Claims, 11 Drawing Sheets

GLIDING TUB AND SHOWER CLEANER

BACKGROUND OF THE INVENTION

The present invention relates generally to cleaning mechanisms for a combination bathtub and shower stall, and more particularly to a system that automatically cleans a combination bath tub and a shower stall.

Bath tubs and showers in motels, hospitals and some gymnasiums must be cleaned on a daily basis for health and sanitation standards. The inner surfaces of bath tubs and showers collect or become spotted and stained with soap residue and dirt. Cleaning is typically done by hand with a sponge and a cleaning solution. The cleaning process is typically very labor intensive and therefore expensive. The cleaning solution must be put on the surface to be cleaned and the surface rubbed and then the surface must be rinsed. Many hospitals and hotels and even individual residents would like to forego this task for something that is easier, cheaper and takes less time than the traditional hand scrubbing method.

As a result of the increasing cost of manual labor and the undesirability of performing such tasks, attempts have been made to improve the cleaning operation of these bathtubs and shower enclosures. In particular, the prior art has addressed the problem of the daily cleaning of public and private bath and shower facilities. Such attempts have included the design of cleaning machines and complicated cleaning systems suspended from the ceiling. A number of stationary or in situ devices have been devised for spray-cleaning the inside wall surfaces of rest rooms. Representative U.S. patents showing spray-cleaning apparatus in rest rooms are: U.S. Pat. Nos. 3,381,312; 3,713,716; 3,742,520; and 3,837,011. A water distribution system for showers is disclosed in U.S. Pat. No. 4,554,690. In U.S. Pat. No. 4,383,341, issued May 17, 1983, a spring loaded series of spray nozzles were used to spray the sides of the bathtub. However, the device, with the numerous elements, was difficult to manufacture and was also inconvenient to use, since it required that cleaning detergent be added prior to each use.

SUMMARY OF THE INVENTION

In view of the foregoing disadvantages inherent in existing cleaning mechanisms for the sanitation and cleaning of bathtubs and showers, the present invention provides an apparatus that will clean a bathtub and/or shower with little or no manual labor. The present invention will automatically spray clean and brush the walls of a bathtub and a shower stall. The present invention has the capacity to control the cleaning of several shower stalls or shower stall and bathtub combinations. This makes the present invention particularly useful in a gymnasium setting where several showers must be cleaned. This system has a cleaning and a rinse cycle and has brushing attachments for cleaning both the bathtub and shower portion. The apparatus of the present invention remains substantially hidden from view and will not compromise the natural beauty of a bathroom. The present invention will run for several cycles before it needs any refilling of cleaning solution. The apparatus is switched on manually.

To attain this, the present invention provides a gliding tub and shower cleaning device for automatically cleaning a bath tub and a shower stall. The device consists of a tub glider, a shower glider, and a control center. The tub and shower gliders have brushes attached and are moved around the inside of the shower stall and the bathtub on tracks. The tracks contain a continuous fluid path for transporting fluid from the control center to the gliders. The tub and shower gliders spray a cleaning solution mixture and the brushes contact and remove dirt and grime from the walls and bottom of the shower and bathtub. The wash cycle is followed by at least one rinse cycle.

It is a first object of the invention to provide an apparatus that will automatically clean a bathtub and a shower stall without the arduous hand labor that is normally involved.

Another object of the invention is to eliminate the expensive and time consuming hand labor that is typically involved in the cleaning and sanitation of a bathtub and shower stall.

It is yet another object of the invention to have a cleaning system that is aesthetically pleasing and does not compromise the natural beauty of a bathroom.

It is a further object of the invention to have a device which is installed as a complete unit integral with a new bathtub or shower stall or easily and cheaply installed as a retrofit into existing bathtubs or shower stalls.

It is a further object of this invention to have a cleaning device that is easy to setup and operate, with low maintenance, and able to run more than one complete cycle without needing human interaction.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 2:
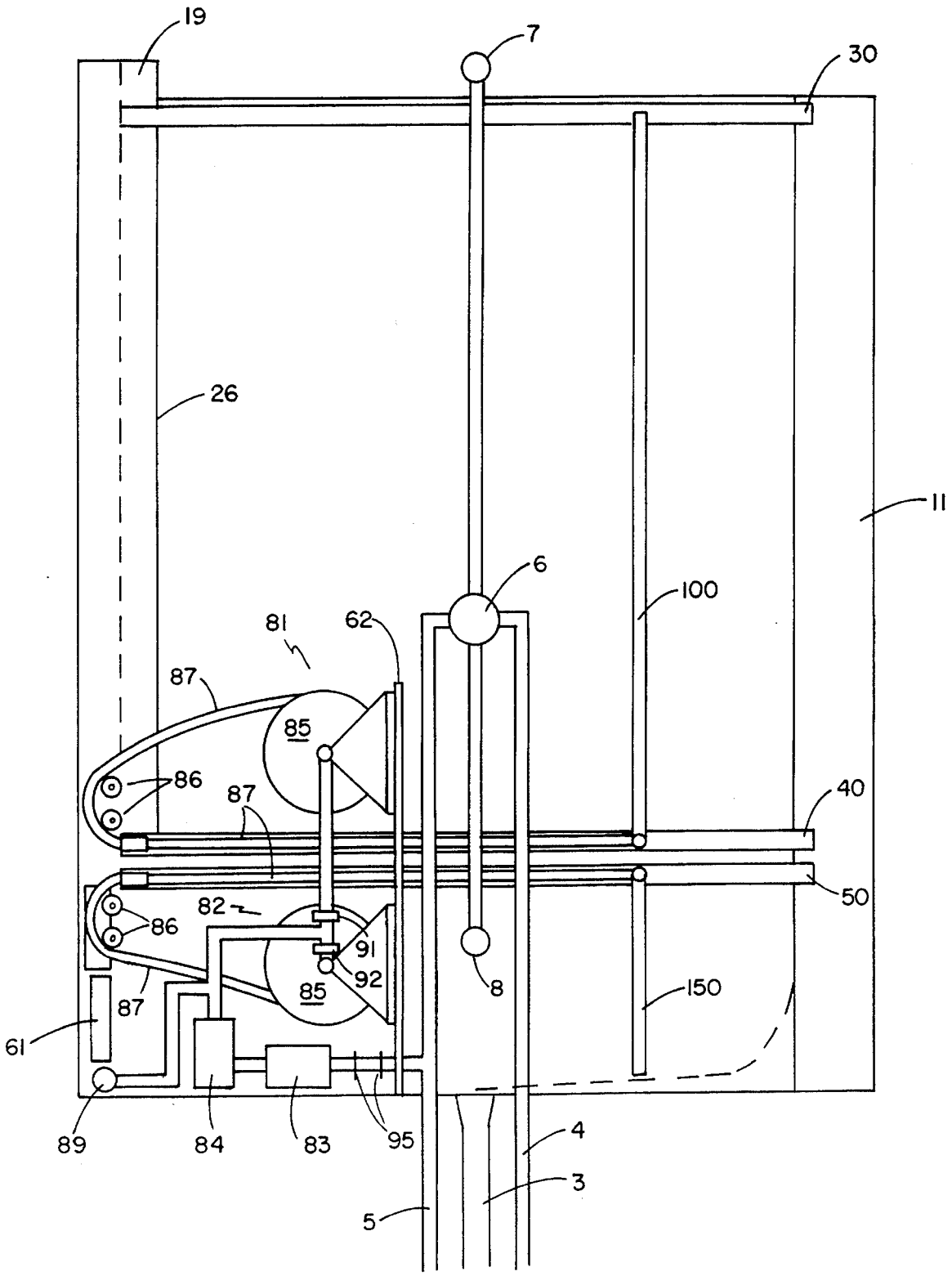
FIG. 2 is a side elevational plan view of the invention illustrated in FIG. 1.
Figure 3:
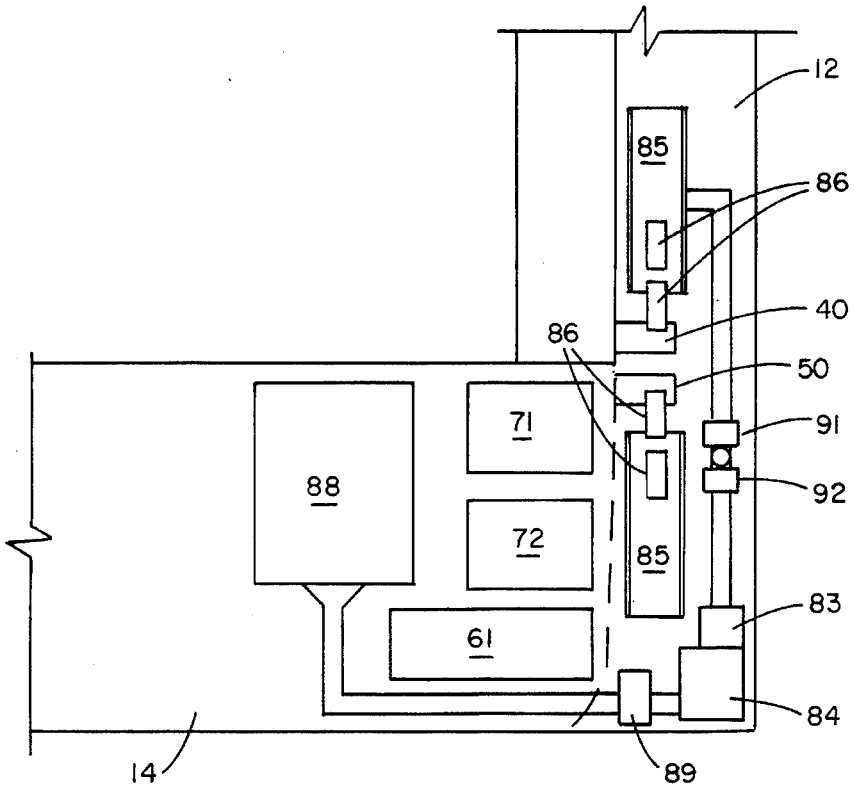
FIG. 3 is a front elevational plan view of the control subsystem portion of the invention illustrated in FIG. 1.
Figure 4:
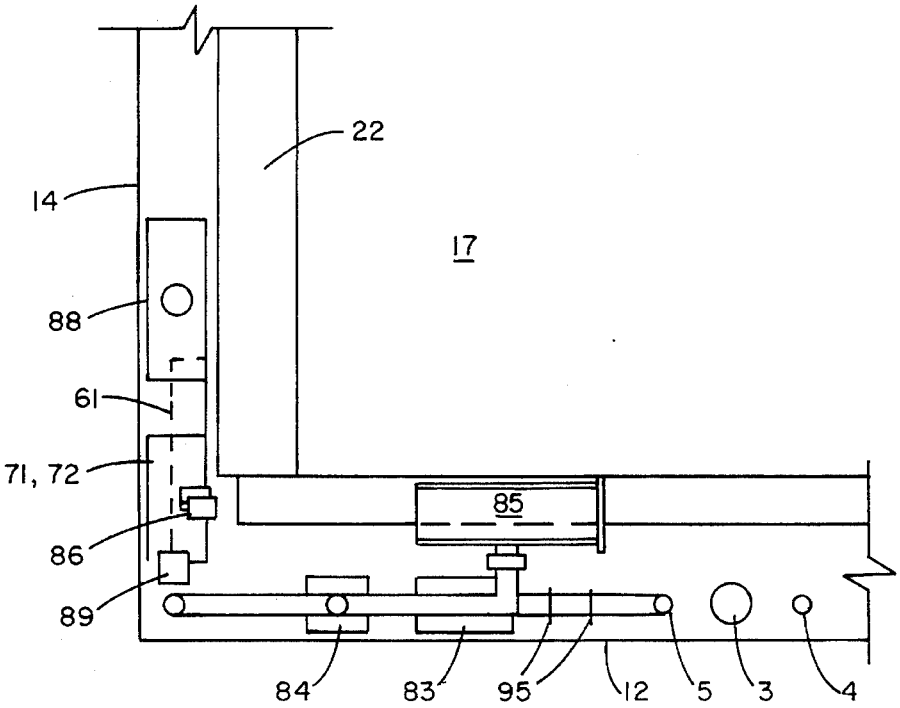
FIG. 4 is a top plan view of the control subsystem.
Figure 5:
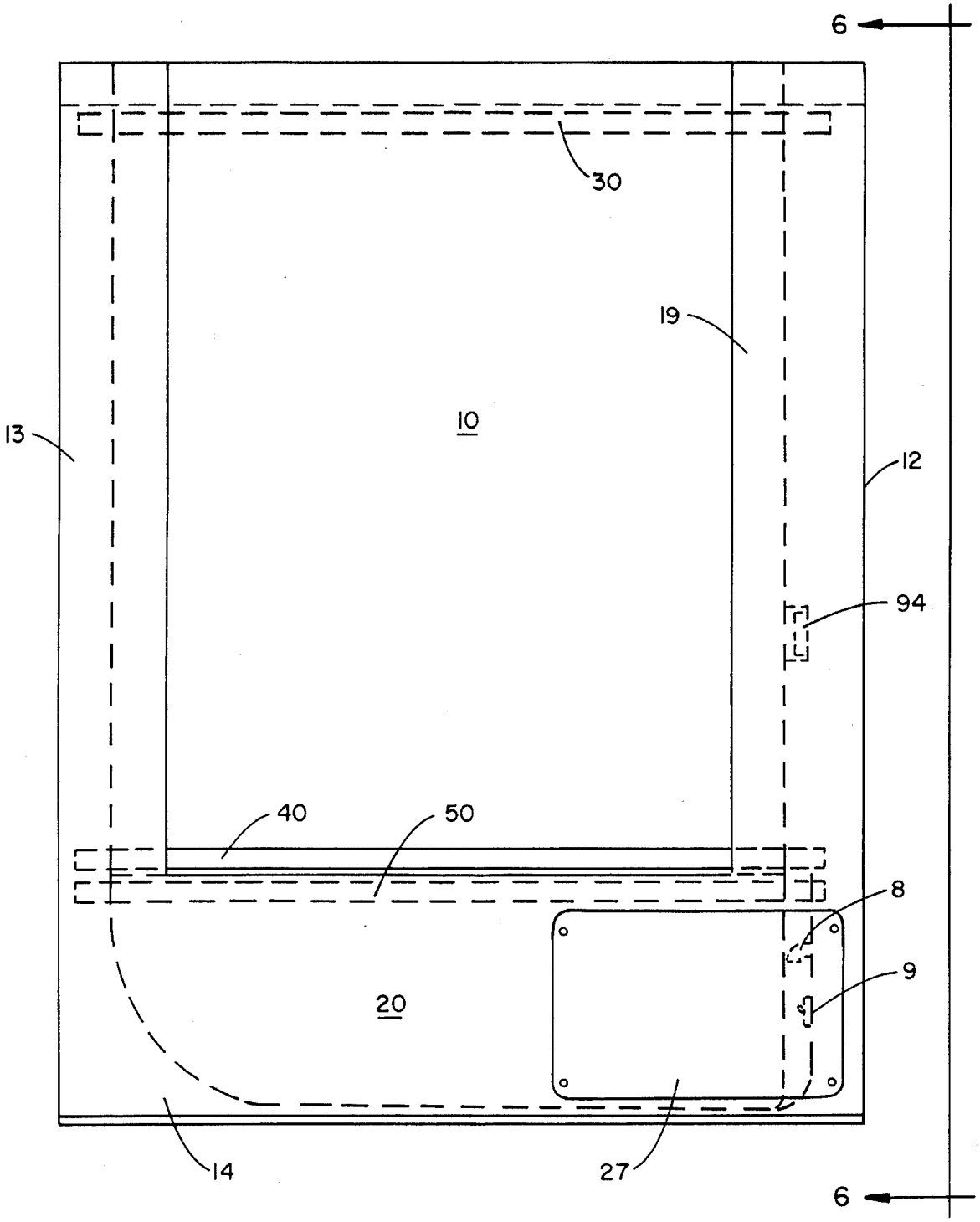
FIG. 5 is a front elevational view of the shower/bathtub combination modified for installation of the present invention.
Figure 6:
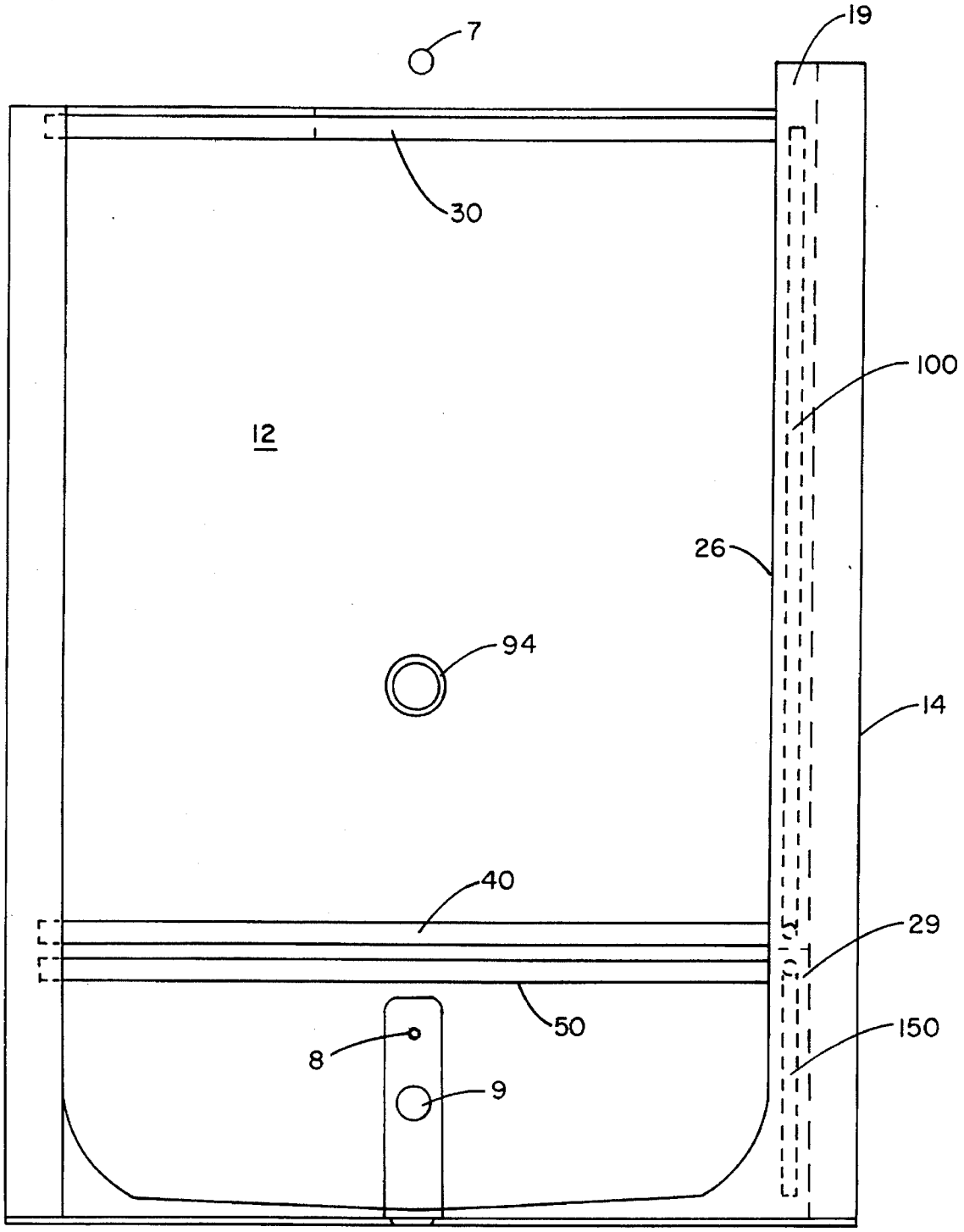
FIG. 6 is a side elevational view along line 6—6 in FIG. 5 with a wall broken away.
Figure 7:
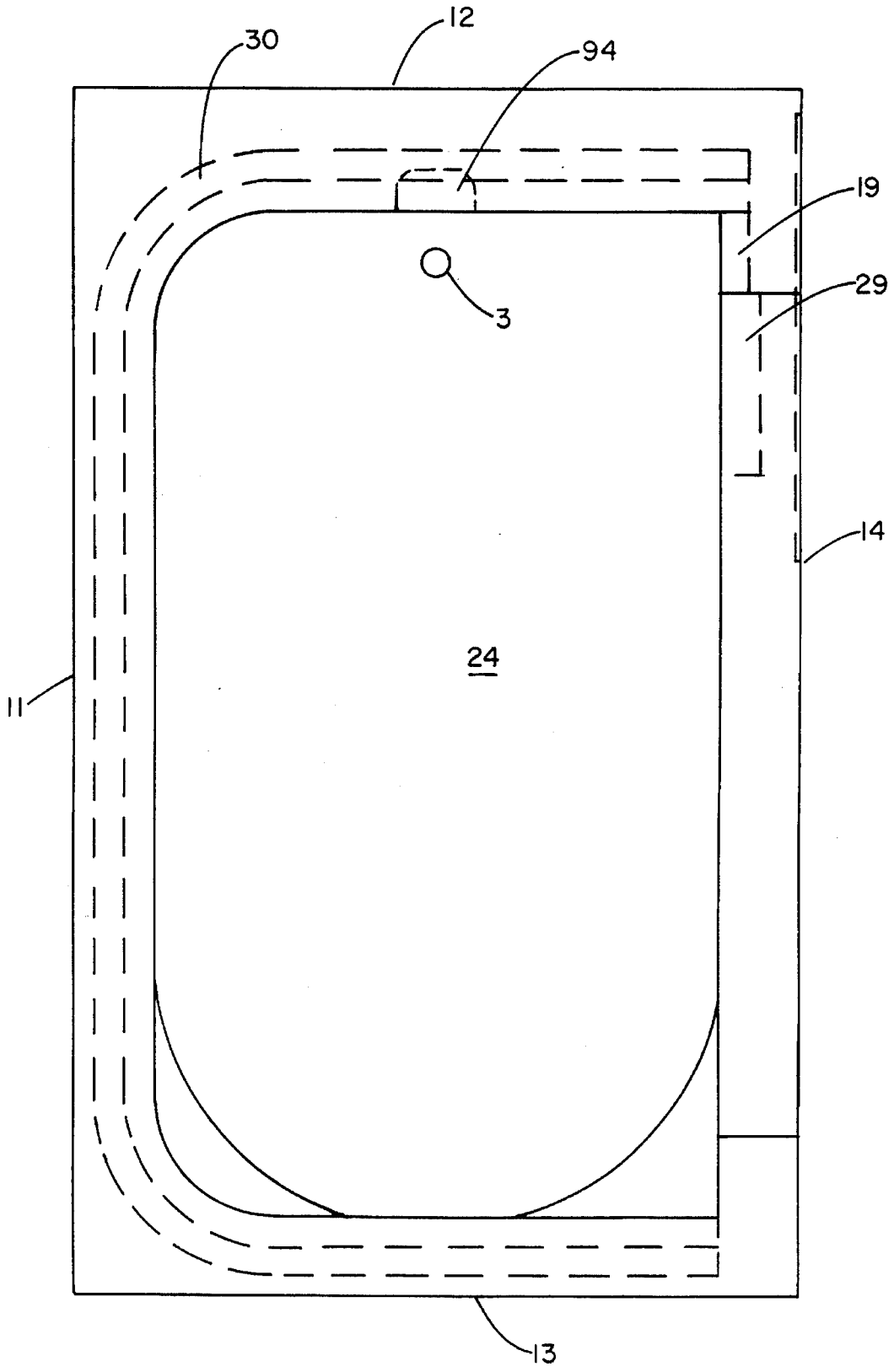
FIG. 7 is a top plan view of the shower/bathtub combination modified for installation of the present invention.
Figure 8:
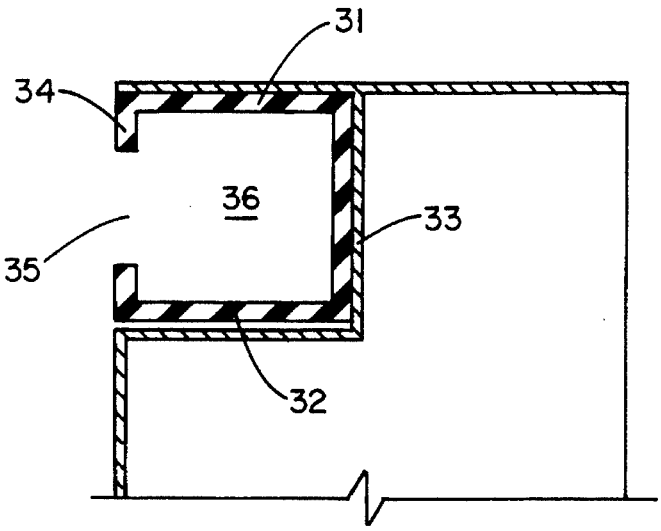
FIG. 8 is a cross sectional view of the roller track shell.
Figure 9:
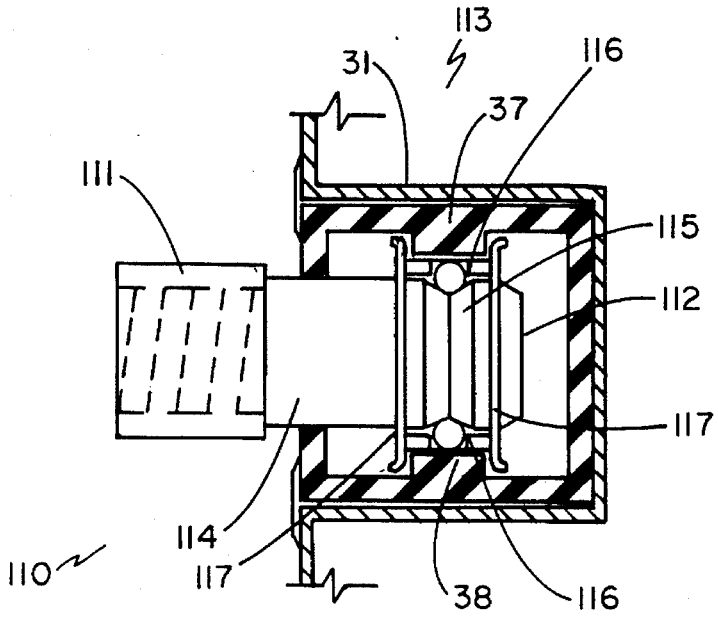
FIG. 9 is a cross sectional view of the roller track assembly.
Figure 10:
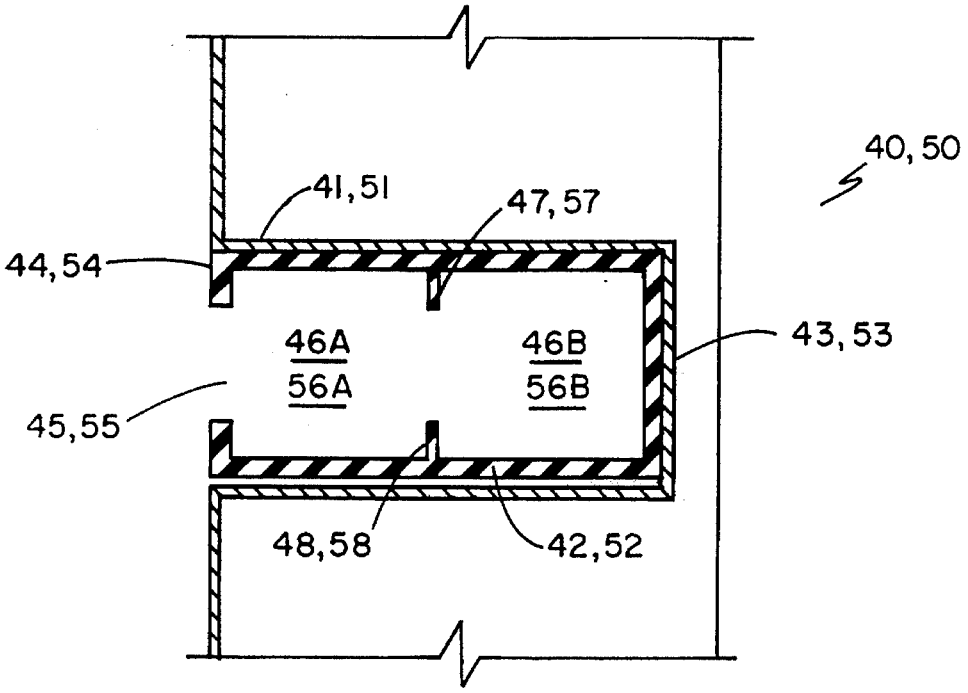
FIG. 10 is a cross sectional view of the drive track shell.
Figure 11:
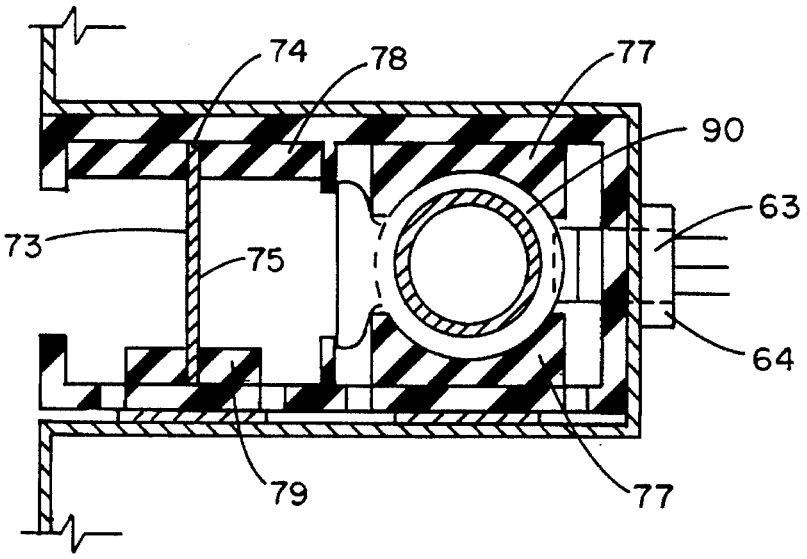
FIG. 11 is a cross sectional view of the drive track assembly.
Figure 12:
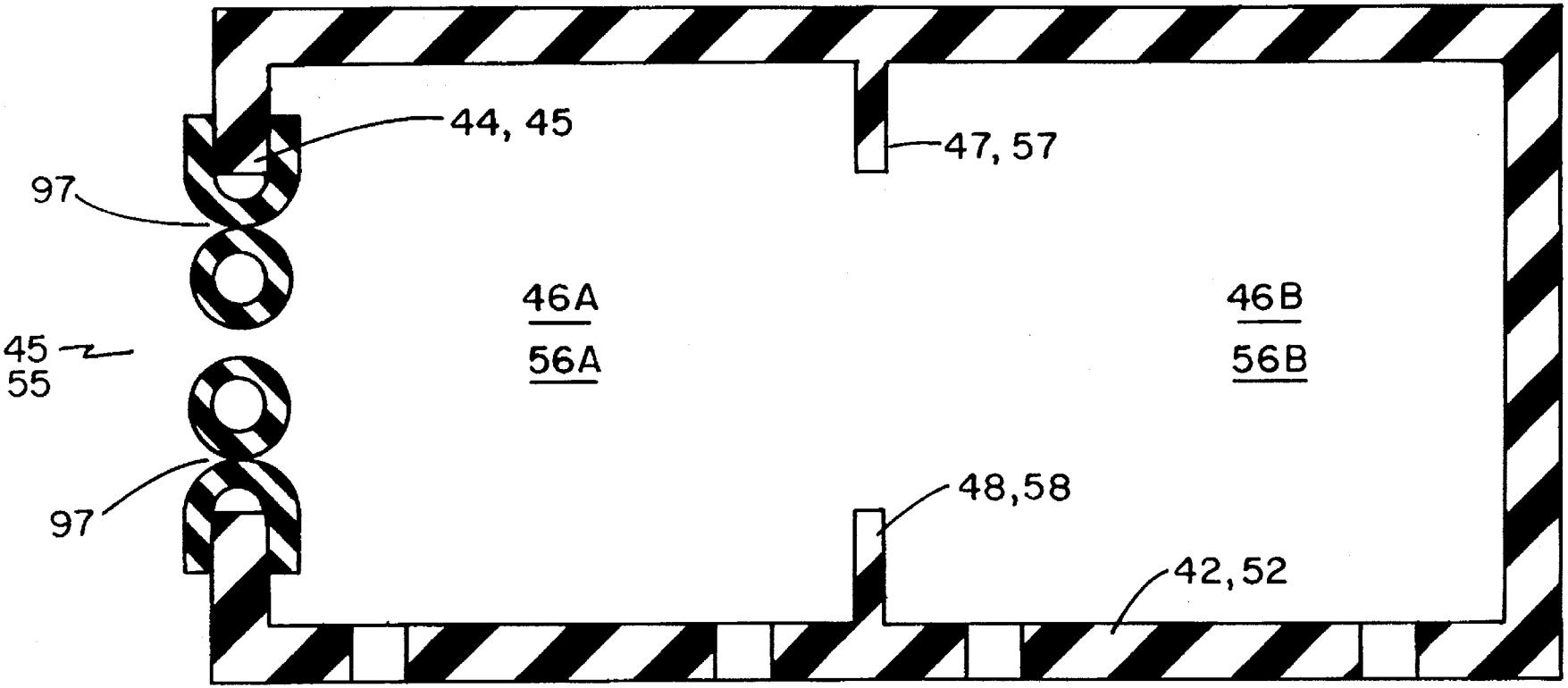
FIG. 12 is a cross sectional view of the track gasket.

Referring to the drawings in detail wherein like elements are indicated by like numerals, there is shown an embodiment of the invention 1 incorporating a gliding tub and shower cleaner. The cleaner 1 consists of a shower glider subsystem 100, a tub glider subsystem 150, and a control subsystem 60. In this embodiment of the invention, the invention 1 is installed on and in a combination bathtub/shower stall 2. As may be seen more fully in FIG. 2, the combination 2 has a drain 3, hot water supply 4, and a cold water supply 5. Referring again to FIG. 2 and also to FIGS. 3 and 4, the combination 2 also has a conventional bath and shower valve assembly 6 as well as invention check valves 95. Reference numeral 7 refers to the shower head; reference numeral 8 refers to the bathtub faucet and faucet hole; and reference numeral 9 refers to the drain release. The shower stall portion 10 of the combination 2 shown is a conventional shower stall in a generally rectangular configuration having a rear wall 11, opposed spaced side walls 12 and 13, and an open front 14 which may be enclosed with a conventional shower curtain (not shown) or shower doors (not shown), but still enabling the user to pass through the front opening 14 to gain access into the shower stall 10. The rear wall 11, opposed spaced side walls 12 and 13, and front 14 vertically define the shower stall interior 17. The right wall 12 in this embodiment is termed the plumbing wall as the plumbing (discussed in detail below) for water input and output is located in and adjacent to this wall. The shower stall 10 has a top 15 and a bottom 16 terminating in the bathtub portion 20 of the combination 2. The bathtub portion 20 of the combination 2 consists of a conventional and generally rectangular bathtub in a substantially concave, one-piece structure 21 with steeply sloping continuous side walls 22. The tub 20 fits within and forms a bottom portion of the shower stall 10. The top 23 of the tub side walls 22 joins the shower stall bottom 16.

As may be most clearly seen in FIGS. 5–7, 8 and 10, three continuous, horizontal tracks 30, 40 and 50 are formed about the shower rear and side walls 11, 12 and 13. Each track 30, 40 and 50 has a generally rectangular cross section. The first track 30 is termed the shower roller track and is positioned about the shower stall top 15 on the shower stall rear and side walls 11, 12, 13. The roller track 30 (see FIG. 8) is comprised of an elongated, rigid, hollow and substantially rectangular shaped stock having a horizontal top surface 31, bottom surface 32, and two vertical sides 33, 34. One side 34 (hereinafter the slot side) has an evenly spaced opening forming a track slot 35 running the entire length of the slot side 34. The slot side 34 is that side adjacent the interior 17 of the shower stall 10. The track's hollow interior 36 is termed the roller track channel.

The second and third tracks 40 and 50 are termed the shower drive track 40 and the tub drive track 50, respectively. Both drive tracks 40, 50 are identical. The tracks 40, 50 are positioned about the shower stall bottom 16 on the shower stall rear and side walls 11, 12, 13, adjacent to one another with the shower drive track 40 positioned just above the tub drive track 50. The drive tracks 40, 50 (see FIG. 10) are comprised of elongated, rigid, hollow and substantially rectangular shaped stock having a horizontal top surface 41, 51, bottom surface 42, 52, and two vertical sides 43, 53 and 44, 54. One side 44, 54 (hereinafter the slot side) has an evenly spaced opening forming a track slot 45, 55 running the entire length of the slot side 44, 54. The slot side 44, 54 is that side adjacent the interior 17 of the shower stall 10. The tracks' hollow interiors 46, 56 are subdivided into a drive channel portion 46A, 56A and a water feed channel portion 46B, 56B by two narrow, vertical protrusions 47, 57 and 48, 58, one protrusion 47, 57 extending downward from the top surface 41, 51 and one protrusion 48, 58 extending upward from the bottom surface 42, 52, both sets of which are in the same vertical plane. The interior drive channel portions 46A, 56A are immediately adjacent the slot sides 44, 54.

Figure 13:
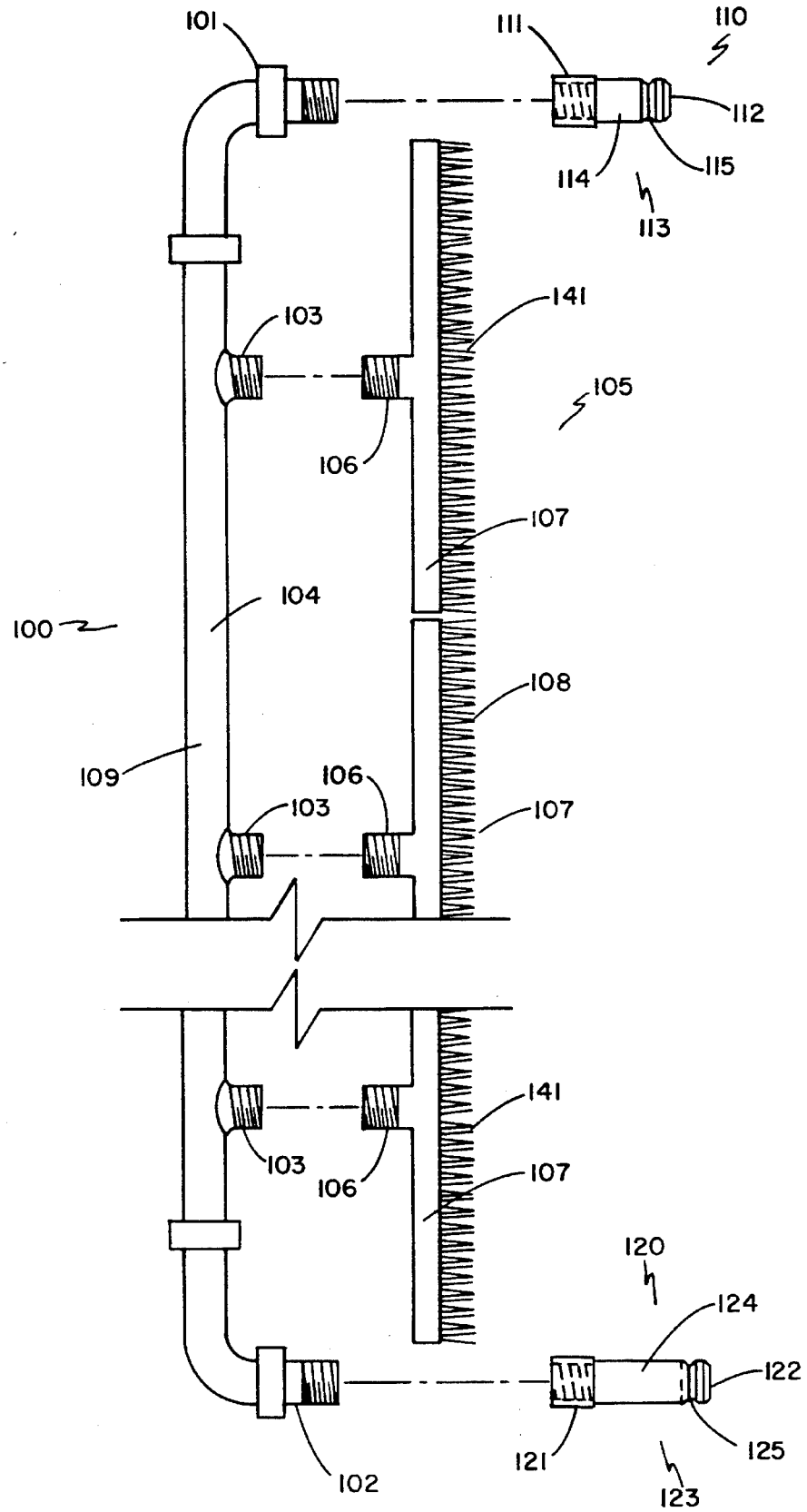
FIG. 13 is a partially exploded, side elevational view of the shower arm assembly.

As may be most clearly seen in FIGS. 1, 2, 9, 11 and 13, the shower glider 100 has a vertical, hollow shower glider pipe 109, having a top end 101 and a bottom end 102, is connected at its top end 101 to the roller track 30 and at its bottom end 102 to the shower drive track 40. The pipe 109 may have a generally rectangular shape (FIG. 1) or a more conventional cylindrical shape (FIG. 13). The top and bottom pipe ends 101, 102 are bent horizontally 90° in the same direction. The glider top and bottom pipe ends 101, 102 are externally threaded. A hollow, internally threaded roller control arm 110 threadingly engages the glider pipe top end 101. The roller control arm 110 has two ends 111, 112. One end 111 is internally threaded and is the end which engages the glider top pipe end 101. The other roller control arm end 112 is sealed, and inserted through the track slot 35 thereby engaging the track 30. The portion 113 of the roller control arm engaging the track 30 has a beveled, radial groove 115 formed about its surface 114 almost at the arm end 112. The track 30 has two blunt, vertical protrusions 37 and 38, one protrusion 37 extending downward from the top surface 31 and one protrusion 38 extending upward from the bottom surface 32, both sets of which are in the same vertical plane. The roller control arm 110 is inserted into the track 30 so that the arm beveled groove 115 is positioned between the vertical protrusions 37, 38. A roller bearing assembly 116 is positioned about the groove 115 and held in place by clips 117 on both sides of the vertical protrusions 37, 38.

A hollow, internally threaded drive control arm 120 threadingly engages the glider bottom end 102. The drive control arm 120 has two ends 121, 122. One end 121 is internally threaded and is the end which engages the glider bottom end 102. The other drive control arm end 122 is inserted through the shower drive track slot 45 thereby engaging the track 40. The portion 123 of the drive control arm 120 engaging the track 40 has a beveled, radial groove 125 formed about its surface 124 almost at the arm end 122. The drive control arm portion 123 passes through the track drive channel portion 46A and into the track water feed channel portion 46B. As will be described in greater detail below, the arm portion 123 engages the drive subsystem 70 in the track drive channel portion 46A and engages the water feed subsystem 80 in the track water feed channel portion 46B.

The shower glider 100 also has a plurality of circular outfeed sleeves 103 formed on its surface 104 through which a water solution may be passed. The outfeed sleeves 103 are positioned in the same direction as the bent glider top and bottom ends 101, 102 and are also externally threaded. Each outfeed sleeve 103 has a cleaning element 105 threadingly attached thereto. Each cleaning element 105 has a short, hollow, horizontal, internally threaded connecting arm 106 terminating in a perforated, vertical cleaning head 107. The connecting arm 106 threadingly engages an outfeed sleeve 103. The cleaning head 107 has a resilient material 108 attached thereto and is adapted to engage the particular wall over which the glider 100 is positioned. The resilient material may be sponge 140 (FIG. 1) or soft bristles 141 (FIGS. 13 and 14), or the like.

Figure 14:
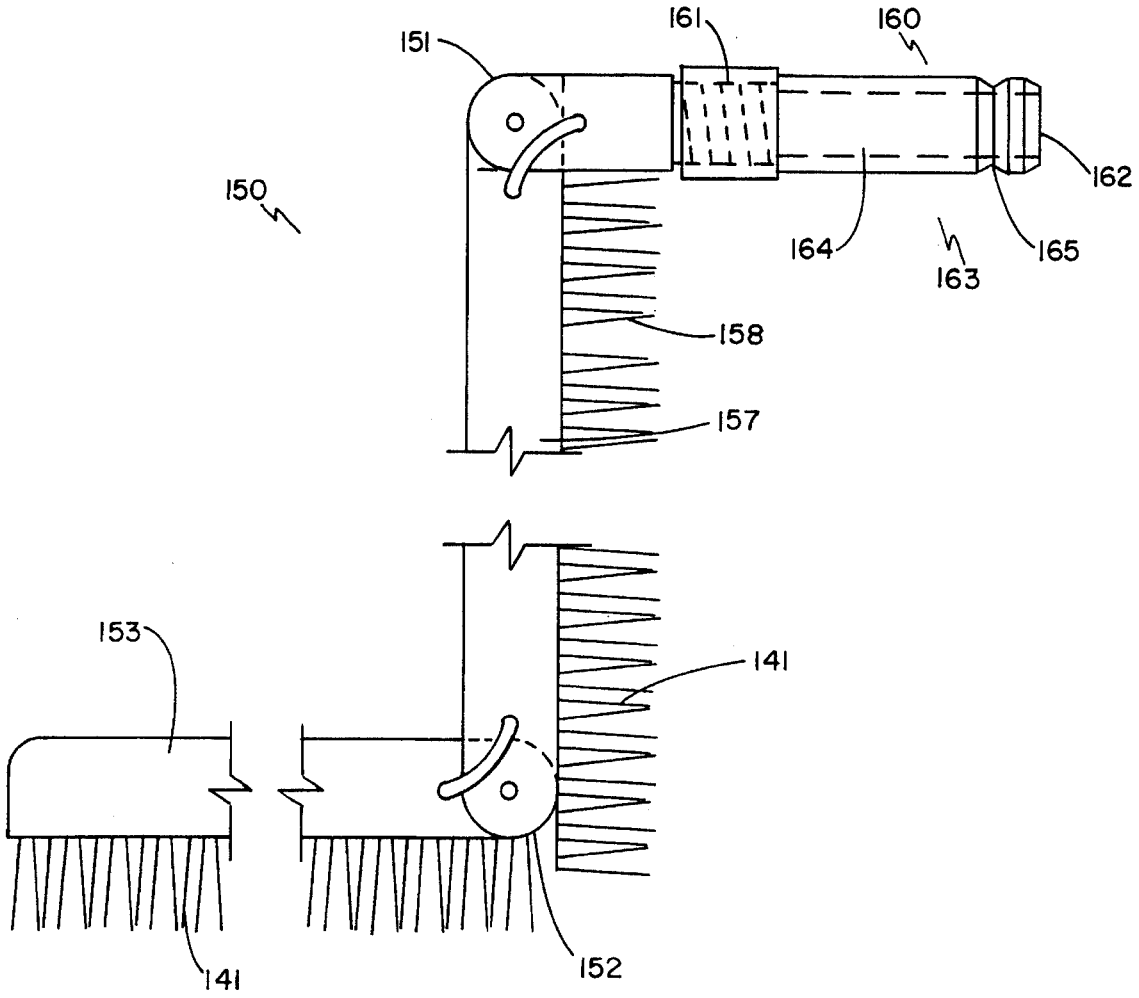
FIG. 14 is a side elevational plan view of the bath tub arm assembly.

As may be most clearly seen in FIGS. 1, 2, 11 and 14, the tub glider 150 has a vertical, hollow tub glider pipe 159, having a top end 151 and a bottom end 152, is connected at its top end 151 to the tub drive track 50. The pipe 159 may have a generally rectangular shape (FIG. 1) or a more conventional cylindrical shape (FIG. 14). The top end 151 is bent horizontally 90°. The glider pipe top end 151 is externally threaded. A hollow, internally threaded drive control arm 160 threadingly engages the glider top pipe end 151. The drive control arm 160 has two ends 161, 162. One end 161 is internally threaded and is the end which engages the glider top pipe end 151. The other drive control arm end 162 is inserted through the tub drive track slot 55 thereby engaging the track 50. The portion 163 of the drive control arm 160 engaging the track 50 has a beveled, radial groove 165 formed about its surface 164 almost at the arm end 162. The drive control arm portion 163 passes through the track drive channel portion 56A and into the track water feed channel portion 56B. As will be described in greater detail below, the arm portion 163 engages the drive subsystem 70 in the track drive channel portion 56A and engages the water feed subsystem 80 in the track water feed channel portion 56B.

The tub glider 150 also has a perforated, vertical cleaning head 157 attached thereto. The cleaning head 157 has a resilient material 158 attached thereto and is adapted to engage the particular wall over which the glider 150 is positioned. The resilient material 158 may be sponge 140 (FIG. 1) or soft bristles 141 (FIGS. 13 and 14), or the like. The glider bottom pipe end 152 terminates in a horizontally, L-shaped glider element 153 positioned generally perpendicular to the tub side walls 22 and adapted to engage the tub floor 24. The bottom element 153 also has a vertical cleaning head 157 attached thereto. The cleaning head 157 also has a resilient material 158 attached thereto and is adapted to engage the tub floor 24 over which the glider bottom element 153 is positioned. The resilient material 158 may be sponge 140 (FIG. 1) or soft bristles 141 (FIGS. 13 and 14), or the like.

Figure 1:
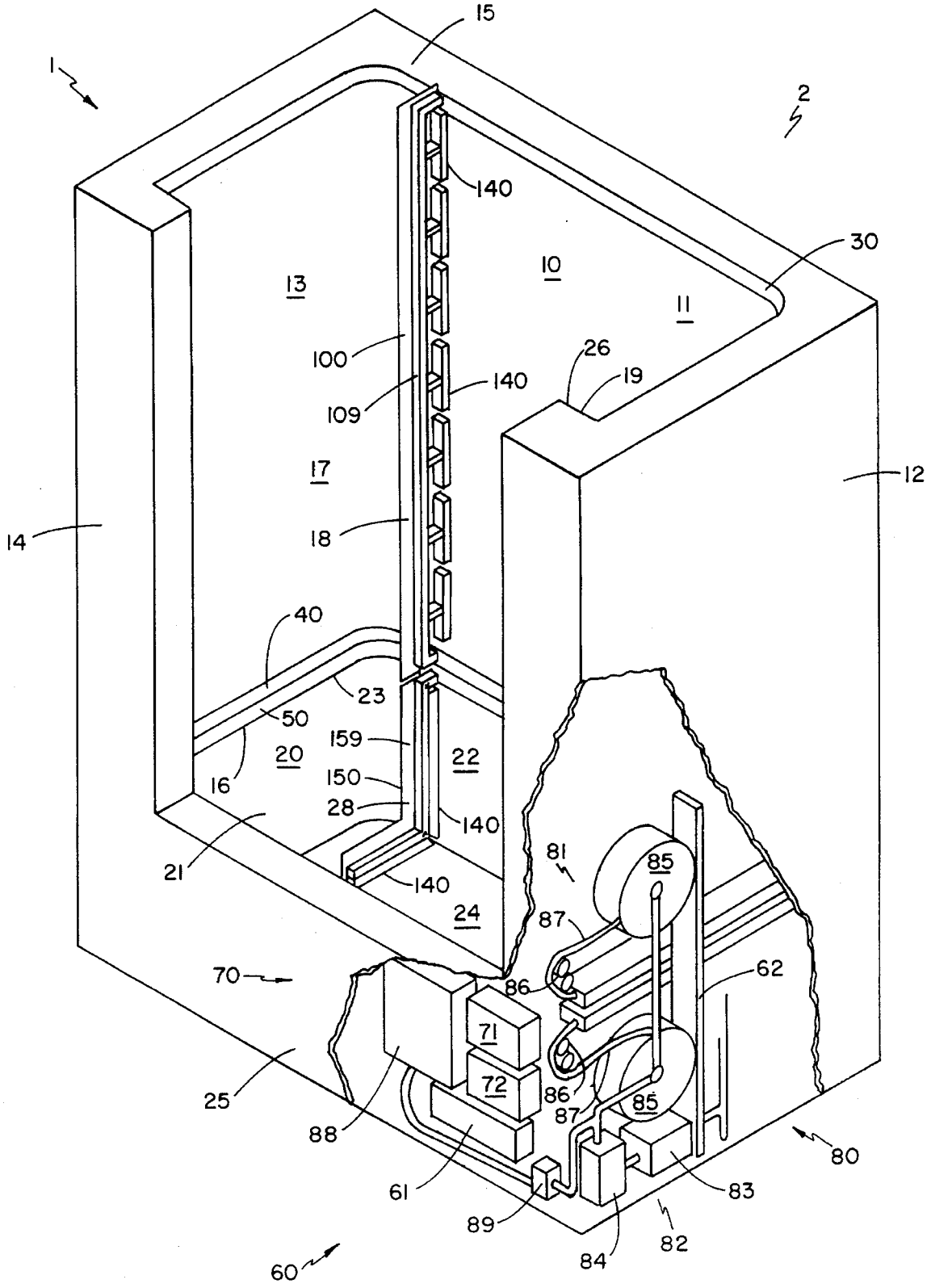
FIG. 1 is a perspective view of the invention installed on a typical shower/bathtub combination, partly broken away.

The interior 26 of the front wall 14, near to the junction with the plumbing wall 12, contains storage compartments 19, 29 for placement of the shower glider 100 and tub glider 150 when not in use. The pipes 109, 159 may be attached to a generally flat, rectangular elements 18, 28 as shown in FIG. 1. The rectangular elements 18, 28 act as surface enclosures when the shower glider 100 and tub glider 150 are fully positioned within the compartments 19, 29. The exterior 25 of the front wall 14 has an panel 27 for access to the control subsystem 60.

The shower glider 100 and the tub glider 150 each are connected to a continuous fluid transfer system 80 and a drive system 70, collectively referred to as the control subsystem 60. As may be seen in FIG. 1 the control subsystem 60 is located generally in the front—right side 14, 12 quadrant of the combination bathtub/shower stall 2. All control subsystem functions are controlled by a logic controller 61.

Figure 15:
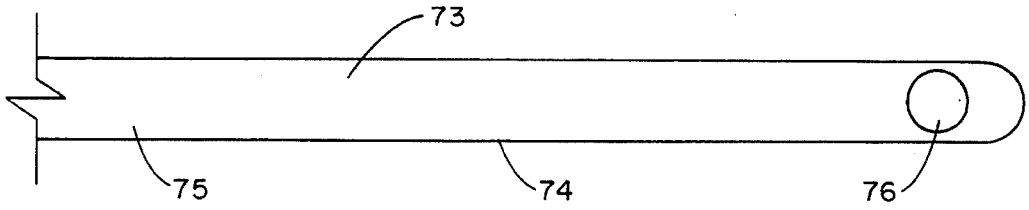
FIG. 15 is a side elevational view of a portion of the drive belt.

The drive subsystem 70 is comprised of two drive motors 71 and 72, one 71 for driving the shower glider 100 and one 72 for driving the tub glider 150. The drive means for each is comprised of a generally flat, horizontal drive belt 73 (see FIG. 15), positioned on a side 74 so that its flat surfaces 75 are in a vertical plane, and having an aperture 76 formed at one end. The aperture 76 is fitted over the drive control arm engagement portion 123, 163 in the drive channel portion 46A, 56A of the pertinent track 40, 50. As may be seen in FIG. 11, spacer blocks 78, 79 are inserted into the drive channel portion 46A, 56A to hold the belt 73 in position. Activation of the drive motors 71, 72 will cause the belts 73 in each track 40, 50 to be advanced or withdrawn, thereby moving the respective gliders 100, 150 in a desired direction.

Figure 16:
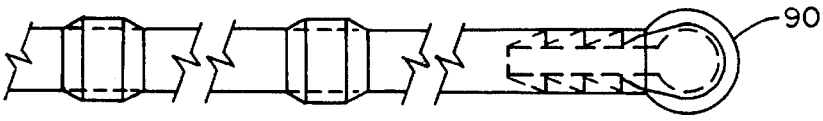
FIG. 16 is a side elevational view of a portion of the water feed hose.

The continuous fluid transfer system 80 is comprised of two parallel distribution systems 81, 82, one 81 for feeding the shower glider 100 and one 82 for feeding the tub glider 150. Water is taken from the main supply, routed through a pressure booster 83, passed through a heater 84 and then into one or both of the distribution systems 81, 82. Each distribution system 81, 82 is comprised of a separately valved 91, 92 plumbing spool 85 mounted on a support element 62 and adjacent rollers 86. Water from the heater 84 is passed to hoses 87 wound about the spools 85. The temperature of the heater 84 may be controlled by a recessed water temperature control 94 in the plumbing wall 12. A separate detergent supply is kept in a reservoir 88 and passed through a detergent mixing valve 89 which inserts a desired amount of detergent into the water exiting from the heater 84. As may be most clearly seen in FIGS. 11 and 16, the hoses 87 are joined to drive control arm engagement ends 122, 162 within the water feed channel portion 46B, 56B of the pertinent track 40, 50. As may be seen in FIG. 11, spacer blocks 77 are inserted into water feed channel portion 46B, 56B to hold the water feed hose connection fitting 90 in position. Activation of the drive motors 71, 72 will cause the belts 73 in each track 40, 50 to be advanced or withdrawn, thereby moving the respective gliders 100, 150 in a desired direction. The hoses 87 are mounted on spring loaded spools 85 which will allow the hoses to be drawn off the spools as the gliders 100, 150 advance. As the gliders 100, 150 are returned to their original starting positions, the spring action on the spools 85 will rewind the hoses 87.

The control subsystem 60 contains check valves 95 positioned between the cold water supply 5 and the pressure booster 83 for controlling the flow of incoming water. The check valves 95 are positioned to allow water to flow into the control subsystem 60 or stop the flow of water to the cold water supply 5. Two additional valves 91, 92 are positioned to direct fluid flow to either the shower glider 100 or the tub glider 150.

The control subsystem 60 contains sensors 63, 64 (see FIG. 11) for sensing the shower glider 100 and tub glider 150 positions and for signaling that the shower glider 100 and/or tub glider 150 has completed one cycle. The control subsystem 60 contains a means for sensing the tub glider position and for signaling that the tub glider has completed one cycle. The sensors 63, 64 are electrically connected to the logic controller 61 which also controls the entire drive subsystem 70.

The shower glider 100 begins operation from its storage compartment 19. The logic controller 61 opens the check valves 95 and water flows into the booster 83 where water pressure is increased and then fed to a heater unit 84 where a preset temperature level is maintained. Temperature is sensed during operation by a temperature sensor 94 in the plumbing wall 12. The heated and pressurized water is then passed through a mixing valve 89 where a detergent from the detergent reservoir 88 is mixed in with the water. The shower glider 100 starts to move around the interior 17 of the shower stall 10 spraying the detergent/water (cleaning) solution on the shower walls 11, 12, 13. As the cleaning solution is sprayed on the shower walls, the resilient material 108 on the glider cleaning heads 107 engage the shower walls and impart a scrubbing action. After the shower glider 100 completes a pass over the shower walls, the mixing valve 89 closes off the detergent. As the shower glider 100 reverses its path, clean rinse water is sprayed on the shower walls, thereby removing the detergent and detergent-trapped scum. The tub glider 150, either simultaneously or separately, is operated in the same fashion.

It is understood that the above-described embodiment is merely illustrative of the application. Other embodiments may be readily devised by those skilled in the art which will embody the principles of the invention and fall within the spirit and scope thereof. For example, the drive slots 45, 55 may have soft rubber seals 97 inserted therein and adapted to fit about the control arm engagement portions 113, 123.

I claim:

1. A gliding tub and shower cleaner in combination with a combination tub and shower stall having a drain, hot water supply, cold water supply, shower head, bathtub faucet, faucet hole, drain release, and a bath and shower water valve assembly, the combination comprising:

a generally rectangular tub in a substantially concave, one-piece structure having a tub floor, steeply sloping continuous side walls, said side walls having a top and a bottom terminating at said tub floor, said tub fitting within and forming a bottom portion of said shower stall;

a generally rectangular shower stall having a rear wall, opposed spaced side walls, and an open front which may be enclosed with a conventional shower curtain or shower doors, but still enabling the user to pass through the open front to gain access into the shower stall, said rear wall, opposed spaced side walls, and front vertically defining the shower stall interior, one of said side walls being termed the plumbing wall, said shower stall having a top and having a bottom which terminates at said tub, said top of said tub side walls joining said shower stall bottom;

three continuous, horizontal tracks formed about the shower stall rear and side walls, each said track having a generally rectangular cross section, one of said tracks being termed the shower roller track and being positioned about the shower stall top on the shower stall rear and side walls, the second and third tracks being termed the shower drive track and the tub drive track, respectively, both of said drive tracks being identical and being positioned about the shower stall bottom on the shower stall rear and side walls adjacent to one another with the shower drive track positioned just above the tub drive track, said drive tracks containing a continuous fluid path for transporting fluid;

a shower glider having a top end attached to said roller track and a bottom end attached to said shower drive track, and a surface with a plurality of circular outfeed sleeves formed thereon through which a fluid solution may be passed, each said outfeed sleeve having a cleaning element attached thereto adapted to engage a shower stall wall;

a tub glider having a top end attached to said tub drive track, and having a perforated cleaning head attached thereto adapted to engage a tub wall, and having a bottom end terminating in a bottom element with a cleaning head attached thereto adapted to engage said tub floor; and a control subsystem positioned within said combination and connected to said shower glider and said tub glider, said control subsystem having a continuous fluid transfer system, a drive system, and a logic controller.

2. A cleaner combination as recited in claim 1, wherein:

said shower roller track being comprised of an elongated, rigid, hollow and substantially rectangular shaped stock having a horizontal top surface, bottom surface, and two vertical sides defining an interior termed the roller track channel, one of said sides, termed the slot side, having an evenly spaced opening forming a track slot running the entire length of the slot side, said slot side being that side adjacent the interior of the shower stall, said track having two blunt, vertical protrusions, one protrusion extending downward from the top surface and one protrusion extending upward from the bottom surface, both protrusions being in the same vertical plane.

3. A cleaner combination as recited in claim 2, wherein:

said drive tracks are each comprised of elongated, rigid, hollow and substantially rectangular shaped stock having a horizontal top surface, bottom surface, and two vertical sides defining an interior, one of said sides, termed the slot side, having an evenly spaced opening forming a track slot running the entire length of the slot side, the slot side being that side adjacent the interior of the shower stall, each of said tracks' hollow interiors being subdivided into a drive channel portion and a water feed channel portion by two narrow, vertical protrusions, one protrusion extending downward from the top surface and one protrusion extending upward from the bottom surface, both protrusions being in the same vertical plane, wherein said interior drive channel portions are immediately adjacent the slot sides.

4. A cleaner combination as recited in claim 3, wherein:

said shower glider has a vertical, hollow shower glider pipe, having a top end and a bottom end, said top end being connected to the said roller track and said bottom end being connected to said shower drive track, said top and bottom pipe ends being bent horizontally in the same direction.

5. A cleaner combination as recited in claim 4, wherein said shower glider is further comprised of:

each top and bottom shower glider pipe end being externally threaded;

a hollow, internally threaded roller control arm having two ends, one said end being threadingly engaged to the glider pipe top end, the other roller control arm end being sealed and a portion of said end being inserted through the shower roller track slot thereby engaging the track, said engagement portion having a beveled, radial groove formed about its surface near to the arm end, wherein said engagement portion beveled groove is positioned between the track hollow interior vertical protrusions;

a roller bearing assembly positioned about said engagement portion beveled groove and held in place by a plurality of clips on positioned on both sides of the vertical protrusions;

a hollow, internally threaded drive control arm having two ends, one said end being threadingly engaged to the glider pipe bottom end, and a portion of the other drive control arm end being inserted through the shower drive track slot and through the track drive channel portion and into the track water feed channel portion, thereby engaging the shower drive track, said engagement portion having a beveled, radial groove formed about its surface near to the arm end, wherein said engagement portion beveled groove is positioned between the track hollow interior vertical protrusions;

wherein said drive control arm engagement portion engages the drive system in the track drive channel portion and engages the continuous fluid transfer system in the track water feed channel portion.

6. A cleaner combination as recited in claim 5, wherein:

the shower glider outfeed sleeves are externally threaded and oriented in the same direction as the glider top and bottom ends;

each outfeed sleeve has a cleaning element threadingly attached thereto;

each said cleaning element has a short, hollow, horizontal, internally threaded connecting arm terminating in a perforated, vertical cleaning head, said connecting arm threadingly engaging an outfeed sleeve;

each said cleaning head has resilient material attached thereto and adapted to engage a shower wall.

7. A cleaner combination as recited in claim 6, wherein:

said tub glider has a vertical, hollow tub glider pipe, having a top end and a bottom end, said top end being connected to the said tub drive track, said top end being bent horizontally.

8. A cleaner combination as recited in claim 7, wherein said tub glider is further comprised of:

said top pipe end being externally threaded;

a hollow, internally threaded drive control arm having two ends, one said end being threadingly engaged to the glider pipe top end, and a portion of the other drive control arm end being inserted through the tub drive track slot and through the track drive channel portion and into the track water feed channel portion, thereby engaging the tub drive track, said engagement portion having a beveled, radial groove formed about its surface near to the arm end, wherein said engagement portion beveled groove is positioned between the track hollow interior vertical protrusions;

wherein said drive control arm engagement portion engages the drive system in the track drive channel portion and engages the continuous fluid transfer system in the track water feed channel portion.

9. A cleaner combination as recited in claim 8, wherein:

the tub glider cleaning heads each have a resilient material attached thereto and adapted to engage a tub surface.

10. A cleaner combination as recited in claim 9, further comprising:

two storage compartments adapted for storage of the shower glider and tub glider, said compartments being formed in the interior of the front wall, near to its junction with the plumbing wall;

a generally flat, rectangular element attached to each glider pipe, each said rectangular element being adapted to act as surface enclosures when the shower glider and tub glider are fully positioned within said storage compartments; and a panel on the exterior of the front wall adapted for access to the control subsystem.

11. A cleaner combination as recited in claim 10, wherein:

said control subsystem drive system is comprised of two drive motors, one for driving the shower glider and one for driving the tub glider, each motor engaging and driving a generally flat, horizontal drive belt having a proximal end and a distal end, said belt being positioned on a side so that its flat surfaces are in a vertical plane, said belt also having an aperture formed in its distal end, said aperture being fitted over the drive control arm engagement portion in the drive channel portion of the pertinent track.

12. A cleaner combination as recited in claim 11, further comprising:

a plurality of spacer blocks inserted into the each drive track's drive channel portion, said blocks being adapted to hold said drive belts in position.

13. A cleaner combination as recited in claim 12, wherein said control subsystem continuous fluid transfer system is comprised of:

two parallel distribution systems, one adapted for feeding the shower glider and one adapted for feeding the tub glider, each said distribution system having a separately valved, spring-loaded, plumbing spool, with a hose mounted thereon, on a support element, and adjacent rollers;

a pressure booster interconnecting said cold water supply and said distribution systems;

a heater inserted between said booster and said distribution systems;

wherein water is taken from said cold water supply, routed through said pressure booster, passed through said heater, and then passed into one or both of the said distribution systems hoses wound about said spools; and a detergent reservoir connected to a detergent mixing valve interconnected between said heater and said distribution systems wherein a separate detergent supply in said reservoir is passed through said detergent mixing valve which is adapted to insert a desired amount of detergent into water exiting from said heater.

14. A cleaner combination as recited in claim 13, wherein:

each said hose is joined to said drive control arm engagement end within a drive track water feed channel portion.

15. A cleaner combination as recited in claim 14, wherein said control subsystem is further comprised of:

a plurality of check valves positioned between the cold water supply and the pressure booster, said valves being adapted to control the flow of incoming water; and two directional valves adapted to direct fluid flow to either the shower glider or the tub glider.

16. A cleaner combination as recited in claim 15, wherein said control subsystem is further comprised of:

a plurality of sensors attached to said drive tracks and adapted for sensing the shower glider and tub glider positions;

electrical means interconnecting said sensors to said logic controller.

* * * * *